United States Patent [19]

Kato

[11] 4,085,182

[45] Apr. 18, 1978

[54] PROCESS FOR PRODUCING ELECTRICALLY CONDUCTIVE SYNTHETIC FIBERS

[75] Inventor: Sumio Kato, Mihara, Japan

[73] Assignee: Teijin Limited, Osaka, Japan

[21] Appl. No.: 620,851

[22] Filed: Oct. 8, 1975

[30] Foreign Application Priority Data

Oct. 9, 1974 Japan ..... 49-115602

[51] Int. Cl.[2] ..... B29F 3/10; D01D 5/12

[52] U.S. Cl. ..... 264/171; 264/176 F; 264/211

[58] Field of Search ..... 264/171, 211, 176 F; 428/370, 373, 375; 252/511

[56] References Cited

U.S. PATENT DOCUMENTS

| | | | |
|---|---|---|---|
| 2,957,747 | 10/1960 | Bowling | 264/176 F |
| 3,175,339 | 3/1965 | McDowell | 264/171 |
| 3,264,390 | 8/1966 | Tanner | 264/171 |
| 3,481,558 | 12/1969 | Davies et al. | 242/159 |
| 3,823,035 | 7/1974 | Sanders | 428/372 |
| 3,946,100 | 3/1976 | Davis et al. | 264/176 F |
| 3,958,066 | 5/1976 | Imamava et al. | 428/372 |

FOREIGN PATENT DOCUMENTS

| | | | |
|---|---|---|---|
| 49-50216 | 5/1974 | Japan | 264/171 |

*Primary Examiner*—Jay H. Woo

*Attorney, Agent, or Firm*—Wenderoth, Lind & Ponack

[57] ABSTRACT

A process for producing sheath-core type electrically conductive synthetic composite filaments, which comprises simultaneously melt-extruding in a sheath/core filament configuration an electrically conductive core composition of a thermoplastic synthetic polymer containing an electrically conductive carbon black dispersed therein and a non-conductive sheath composition of a thermoplastic fiber-forming synthetic polymer, and taking up the extruded sheath-core type synthetic filaments at a take-up speed of at least 2,500 meters per minute; and an electrically conductive sheath-core type synthetic filament having a polyamide sheath.

8 Claims, No Drawings

PROCESS FOR PRODUCING ELECTRICALLY CONDUCTIVE SYNTHETIC FIBERS

This invention relates to electrically conductive fibers or filaments, and more specifically, to a process for producing sheath-core type synthetic composite filaments having superior tenacity and elongation and good dyeability and containing a conductive carbon black dispersed in the core, and to sheath-core type synthetic composite filaments obtained by this process.

Sheath-core type electrically conductive synthetic filaments consisting of a core of an electrically conductive thermoplatistic synthetic polymer containing an electrically conductive carbon black and a non-conductive sheath of a fiber-forming thermoplastic synthetic polymer surrounding the core have already been suggested (see Japanese Laid Open Patent Publication No. 50216/1974). These electrically conductive synthetic filaments have good softness, flexibility and abrasion resistance, and show good conductivity in the as-spun undrawn state. However, they have inferior tenactiy and elongation. When they are drawn, their tenacity and elongation can be improved, but their electric conductivity tends to be reduced. Furthermore, their dyeability is not fully satisfactory.

It is an object of this invention to provide sheath-core synthetic composite filaments having superior tenacity, elongation and dyeability as well as superior softness, flexibility and abrasion resistance, and a process for producing these filaments.

Another object of this inventions is to provide a process for producing sheath-core synthetic composite filaments having superior tenacity, elongation and dyeability as well as superior softness, flexibility and abrasion resistance in a single step and with high productivity without requiring a drawing step.

A further object of this invention is to provide sheath-core type electrically conductive synthetic composite filaments containing a sheath of a polyamide-type synthetic polymer and having a high Young's modulus, a specific stress characteristic at stretch, and improved dyeability.

Other objects and advantages of this invention will become apparent from the following description.

According to this invention, there is provided a process for producing sheath-core type electrically conductive synthetic composite filaments, which comprises simultaneously melt-extruding from a spinneret, in a sheath-core filament configuration, an electrically conductive core composition of a thermoplastic synthetic polymer containing an electrically conductive carbon black dispersed therein and a non-conductive sheath composition (which surrounds the core composition) of a thermoplastic fiber-forming synthetic polymer, and taking up the extruded sheath-core type synthetic filaments at a take-up speed of at least 2,500 meters per minute.

The critical feature of the present invention is that the melt-extruded sheath-core type synthetic filaments are taken up at a take-up speed of at least 2,500 m/min. to increase the amount of deformation of the filaments per unit time.

Usually, electrically conductive carbon blacks have a special chain-like structure (in which fine particles aggregate in clusters and numerous projections are present), and the manner of the chain-like structure being retained in the resulting composite filaments affects the electric conductivity of the filaments.

The chain-like structure of the conductive carbon blacks changes in form by the action of various shearing forces exerted during the formation of the filaments, for example, shearing force exerted in a melter during melt-spinning, or a filter layer in a spinning pack, a shearing force caused by the drafting force during the melt-extrusion of polymer from a spinneret, and a shearing force during a drawing step in a solid state of the filaments. In particular, the chain-like structure changes into a fine grain-like structure by a great shearing force in a drawing step which determines the tenacity and elongation characteristics (i.e., the degree of orientation) of filaments, and the electric conductivity of the resulting composite filaments tends to be greatly reduced.

It has been found that by taking up melt-extruded sheath-core type composite filaments at a high take-up speed of at least 2,500 meters/min. in accordance with this invention, composite filaments having superior electric conductivity and suitable tenacity and elongation characteristics can be obtained without subjecting them to a separate drawing step.

It is essential in the present invention that the composite filaments are melt-extruded from a spinneret, and then taken up at a high take-up speed of at least 2,500 meters/min. The upper limit of the take-up speed is not critical, but can be varied widely according, for instance, to the type of the core and sheath polymers used, and the content of the electrically conductive carbon black in the core. Generally, it is up to 6,000 meters/min., preferably 3,000 to 4,000 meters per minute.

Composite filaments containing electrically conductive carbon black in the core can be stably taken up at such a high take-up speed as at least 2,500 meters/min. after spinning and solidification since the core portion has good dimensional stability. When the take-up speed is less than 2,500 meters/min., the resulting filaments have a high residual elongation and low tenacity. When these filaments are used for static prevention of various fibrous articles, for example, when they are incorporated in carpet threads or woven or knitted fabrics, they undergo plastic elongation owing to stresses exerted on the products such as folding, bending or pulling. This appears on the surface of the product, and the filaments become liable to break. Consequently, the product has reduced antistatic properties.

The amount of the as-spun composite filaments to be deformed per unit time must be increased in the present invention, and for this purpose, it is preferred to take up the filaments at a draft ratio of generally 50 to 1,000, especially 80 to 600.

The process for preparing electrically conductive sheath-core type composite filaments of this invention can be performed by substantially the same procedure as described in the specification of the above-cited Japanese Laid Open Patent Publication No. 50216/74, except that the as-extruded filaments are taken up at a take-up speed of at least 2,500 meters/min.

The thermoplastic fiber-forming synthetic polymer used as a sheath in the present invention is generally a predominantly linear high-molecular-weight polymer capable of forming fibers having superior tenacity and toughness. Examples of such a polymer are polyamides such as 6-nylon or 6,6-nylon, polyesters such as polyethylene terephthalate or polybutylene terephthalate, and polyolefins such as polyethylene or polypropylene. The polyamides are especially preferred. If desired, 0.5 to 7% by weight of non-transparent white solid particles such as titanium dioxide can be incorporated in the sheath polymer as a delusterant.

Generally, thermoplastic synthetic polymers having softness, a low melting point, and melt viscosities equal to or lower than those of the sheath polymers are preferred as the thermoplastic synthetic core polymer in which electrically conductive carbon black is to be dispersed. The core composition need not have fiber-forming ability for itself, but the core polymer should be thermally stable and extrudable under conditions required to spin the sheath polymer. Suitable thermoplastic synthetic polymers for core formation are, for example, polyolefins such as polyethylene or polypropylene, polyamides such as 6-nylon or 6,6-nylon, and polyesters such as polyethylene terephthalate or polybutylene terephthalate. Of these, polyethylene, polypropylene, 6-nylon and 6,6-nylon are preferred. The 6-nylon and 6,6-nylon are especially preferred. Oils and waxes may be incorporated in these polymers in order to improve their processability.

The electrically conductive carbon black to be dispersed in the core polymer may be those commercially available as a conductive grade, for example, Denka Black (a product of Denki Kagaku Kogyo Co., Ltd.) and VULCAN XC-72 and VULCAN SC (products of Cabot Corporation). The concentration of the carbon black is generally 15 to 50% by weight, but in order to impart high electric conductivity and retain moderate processability, it is preferably 20 to 35% by weight.

The carbon black can be dispersed in the core polymer by any conventional mixing method.

The core-to-sheath ratio of the composite filaments in the present invention is preferably 2:98 to 30:70, especially 3:97 to 20:80, in view of the spinnability of the polymers and the post-processability of the as-spun filaments.

The sheath-core composite filaments in accordance with this invention can be easily prepared using a conventional sheath-core spinning apparatus and a conventional spinning method (for example, the method disclosed in U.S. Pat. No. 2,936,482).

In order to prevent the destruction of the chain-like structure of the electrically conductive carbon black in the core to a maximum extent, it is advantageous to feed a melt of a core composition containing electrically conductive carbon black into the core side of a conjugate spinneret either (i) directly without filtering, (ii) after filtering it through a wire gauze of not more than 200 mesh, preferably not more than 100 mesh, or (iii) after filtering it through a wire gauze of not more than 200 mesh, preferably not more than 100 mesh, and a granular filtering material such as glass beads or sands having an average particle diameter of at least 150 microns, preferably at least 200 microns.

Thus, according to this invention, electrically conductive sheath-core type synthetic composite filaments having feasible tenacity and elongation and good dyeability as well as superior softness, flexibility and abrasion resistance can be prepared with high productivity merely by a spinning process, without going through a special drawing step.

The composite filaments provided by this invention exhibit superior conductivity, and when subjected to a direct current potential of 90 V, have an electric resistance of less than $10^{11}$ ohms/cm, usually on the order of $10^8$ to $10^9$ ohms/cm. The denier size of the composite filaments is not critical, but can be varied according to the desired use. Generally, the monofilament denier size is 3 to 15 denier, preferably 5 to 10 denier.

Preferred species of the composite filaments provided by this invention are sheath-core type synthetic filaments whose sheath is composed of a polyamide, especially 6-nylon.

The composite filaments prepared by the process of this invention and containing a polyamide sheath are novel electrically conductive sheath-core composite synthetic filaments having a high Young's modulus of at least 110 Kg/mm$^2$, generally 125 to 220 Kg/mm$^2$, and a stress characteristic at stretch expressed by the following equation $$0.05 \leqq \frac{S_{10} - S_5}{5} \leqq 0.28$$

preferably, $$0.07 \leqq \frac{S_{10} - S_5}{5} \leqq 0.22$$

wherein $S_{10}$ and $S_5$ represent a stress in g/de at 10% and 5% stretches respectively in a load-elongation curve of the filaments, in spite of the fact that the filaments have not gone through a drawing step.

The "load-elongation curve", as used in the present application, is measured at a pulling speed of 30 cm/min. using a tensile tester equipped with a low-speed elongation tester by a method in accordance with the measurement of tenacity and elongation described in Japanese Industrial Standards, JIS-L-1070. The value of $(S_{10} - S_5)/5$ corresponds to a gradient of the load-elongation curve when it is assumed that the curve is a straight line. The $(S_{10} - S_5)/5$ value increases with increasing degree of orientation of the filaments. Generally, this value is about 0.4 for drawn polyamide filaments. In contrast, the composite filaments of this invention having a polyamide sheath are characterized by their high Young's modulus in spite of the fact that their $(S_{10} - S_5)/5$ value is below 0.28. These filaments, concurrently having such Young's modulus and $(S_{10} - S_5)/5$ value, cannot be prepared by ordinary spinning — drawing processes, but can be provided for the first time by the process of this invention.

The composite filaments containing a polyamide sheath and prepared by the process of this invention further have the advantage that the sheath contains a crystal structure having a major proportion of $\gamma$-crystals, and the composite filaments of this invention have good dyeability as will be shown later in Examples.

The core of the composite filaments having a polyamide sheath can be composed of any of the polymers illustrated hereinabove, but preferably polyamides, especially 6-nylon, are used. The concentration of the electrically conductive carbon black can be within the above-specified range.

The core-to-sheath weight ratio of these preferred composite filaments can also be within the above-specified range, that is, 2:98 to 30:70, preferably 3:97 to 20:80.

The composite filaments having a polyamide sheath have properties intermediate between those of undrawn filaments and drawn filaments. They have high tenacity and low elongation. Generally, the tenacity is at least about 2 g/denier, usually 2.5 to 3.5 g/denier, and the elongation is generally not more than 100%, usually 60 to 100%.

The process of the present invention described above makes it possible to produce sheath-core synthetic composite filaments having superior electric conductivity, good dyeability and markedly improved tenacity and elongation characteristics easily and with high productivity by a single-step process without going through two steps of spinning and subsequent drawing. The industrial significance of the process is therefore indeed great. These composite filaments can be used widely as materials for antistatic fibrous products such as woven, knitted and non-woven fabrics and tufted cloth, especially in carpets.

The composite filaments provided by this invention can be subjected to various ordinary processing steps such as crimping, scouring or bleaching, and can be mix-spun or mix-woven with other fibers or filaments in the form of continuous filaments or staple fibers.

For example, in order to remove ignition shocks that may be caused by the sparking of the material of working wear in general, cold-proof garments or dustproof garments, or prevent the adhesion of dust thereto by static charge, 0.2 to 2% by weight, based on the entire fabric, of the composite filaments of this invention can be mix-woven or mix-knitted with other fibers. The suitable amount of the composite filaments of this invention to be mix-twisted or mix-woven to form carpets is 0.05 to 2% by weight. For the static prevention of industrial materials such as an electricity-removing filter bag, the suitable amount of the composite filaments of this invention is 0.5 to 5% by weight.

The following Examples further illustrate the present invention. The properties of the composite filaments obtained in these examples were measured by the following methods.

(1) TENACITY AND ELONGATION

Measured in accordance with "a method for tensile testing of filament yarns" set forth in Japanese Industrial Standards JIS L-1070. Using a tensile tester equipped with a low-speed elongation tester, a filament yarn sample having a length of 25 cm was pulled at an initial load of 1/30 g/denier and a pulling speed of 30 cm/min. The breakage points of monofilaments constituting the sample filament yarn were measured, and its tenacity and elongation were calculated from the measured values.

(2) YOUNG'S MODULUS

Measured on the basis of the rising of a load-elongation curve.

(3) ELECTRIC RESISTANCE

A sample of composite filament, cut to a predetermined length, was fixed at both ends with an electrically conductive paste. A potential of 90 V was applied to the sample using a vibratory microvoltammeter (Model TR-84M, a product of Takeda Riken Company), and its electric resistance was measured.

(4) INITIAL FRICTIONAL VOLTAGE

A sample of a knitted fabric containing the composite filaments of this invention was rotatingly rubbed with a cotton cloth at a speed of 700 rpm using a rotary static tester at a temperature of 25° C. and a relative humidity of 65%, after which the static charge voltage of the sample was measured.

(5) FRICTIONAL VOLTAGE AFTER PULLING AND RUBBING

The frictional voltage after pulling and rubbing was measured for the purpose of anticipating stress that would be exerted in an end usage of the product. A sample of a knitted fabric containing the composite filaments of this invention, 10 cm × 10 cm in size, was fixed at both ends, and using a tensile tester equipped with a low speed elongation tester, the sample was stretched 50% ten times at a speed of 1 rpm, and then subjected to the plane surface rubbing 2 of JIS L-1004 100 times. Then, the voltage of the sample was measured.

EXAMPLE 1

25 Parts by weight of a fine powder of electrically conductive carbon black (COLUMBIA CARBON, a product of Nihon Columbia K.K.) was added to 75 parts by weight of polycapramide having an intrinsic viscosity, as measured on a meta-cresol solution at 35° C., of 0.91. They were melt-mixed in an atmosphere of nitrogen, and the mixture was extruded, cooled, and cut to form chips of the polymer containing the electrically conductive carbon.

The resulting chips as a core polymer and chips of polycapramide having an intrinsic viscosity, as measured on a meta-cresol solution at 35° C., of 1.07 as a sheath polymer were co-spun at varying take-up speeds to produce concentric core-sheath type composite filaments.

The spinning pack had a filtering area of 15.9 $cm^2$ both on the core side and the sheath side. A 20-mesh wire gauze was used in the filtering layer on the core side of the spinning pack. The filter layer on the sheath side consisted of an upper layer of 10 g of glass beads having an average particle diameter of 160 microns, an intermediate layer of 20 g of glass beads having an average particle diameter of 100 microns and a lower layer of 10 g of glass beads having an average particle diameter of 160 microns, and a 325-mesh wire gauze and a 50-mesh wire gauze placed beneath the lower filter layer. The core-to-sheath ratio was 1:9, and the temperature of the polymers was 260° C. The number of the filaments was 3. The amount of the polymers melt-extruded was adjusted so that the denier size of the filaments became 30 denier/3 filaments under the take-up conditions. The tenacity, elongation, Young's modulus, $(S_{10} - S_5)/5$ value, and electric resistance of the resulting filaments were measured.

The resulting filaments were mixed with a nylon-6 yarn (200 de/34 fil) by a turbulent flow type air nozzle, and a knitted fabric was produced using the mixed yarn. The initial frictional voltage and the frictional voltage after pulling and rubbing of the knitted fabric were measured.

The results are shown in Table 1.

Table 1

| Run No. | Take-up speed (m/min.) | Tenacity (g/de) | Elongation (%) | Young's modulus (Kg/mm²) | $\frac{S_{10} - S_5}{5}$ | Electric resistance (ohms/cm) | Initial frictional voltage (V) | Frictional voltage after pulling and rubbing (V) |
|---|---|---|---|---|---|---|---|---|
| 1 (comparison) | 1000 | 1.50 | 283.2 | 63 | 0.01 | $6.2 \times 10^9$ | 125 | 2724 |
| 2 (comparison) | 2000 | 1.98 | 132.4 | 88 | 0.02 | $7.3 \times 10^9$ | 130 | 1080 |
| 3 (invention) | 2500 | 2.77 | 78.1 | 115 | 0.06 | $8.1 \times 10^9$ | 135 | 249 |
| 4 (invention) | 3000 | 2.90 | 69.8 | 133 | 0.08 | $7.8 \times 10^9$ | 132 | 195 |
| 5 (invention) | 3500 | 3.02 | 65.3 | 145 | 0.12 | $9.4 \times 10^9$ | 137 | 187 |

In Run Nos. 1 and 2 (comparison), the frictional voltage after pulling and rubbing were very much increased. A microscopic examination of the surface of each of the knitted fabrics used in these runs showed that most of the composite filaments were broken and partly dropped off.

The composite filaments used in Run Nos. 1 to 5 were dissolved in formic acid, and the form of the electrically conductive carbon black was examined. It was found that in all of the filaments, the carbon black retained more than 90% of its chain-like structure.

COMPARATIVE EXAMPLE 1

Composite filaments were prepared using the same apparatus and under the same conditions as in Example 1 except that the take-up speed was adjusted to 1000 m/min. and the denier size of the filaments after drawing was 30 de/3 fil. in accordance with a conventional process.

The resulting undrawn filaments were drawn at a draw ratio of 2.5 at a drawing speed of 800 m/min. The electric resistance of the filaments was measured.

The undrawn filaments had an electric resistance of $6.5 \times 10^9$ ohms/cm, but the drawn filaments had an electric resistance of $1.1 \times 10^{12}$ ohms/cm and thus exhibited poor electric conductivity.

The properties of the undrawn and drawn filaments were as follows:

| | Undrawn filaments | Drawn filaments |
|---|---|---|
| Tenacity (g/de) | 1.40 | 2.56 |
| Elongation (%) | 295.3 | 71.5 |
| Young's modulus (Kg/mm²) | 61 | 192 |
| $\frac{S_{10} - S_5}{5}$ | 0.01 | 0.30 |

The undrawn and drawn filaments were dissolved in formic acid, and the form of the electrically conductive carbon black contained in the filaments was examined. It was found that the carbon black in the undrawn filaments retained more than 90% of its chain-like structure, whereas about 90% of the chain-like structure of the carbon black contained in drawn filaments was destroyed and changed into a fine grain-like structure.

EXAMPLE 2

Sheath-core type composite filaments were prepared in the same way as in Example 1 except that the take-up speed was changed to 3,500 m/min. and the core-to-sheath ratio was varied as indicated in Table 2. The tenacity, elongation, Young's modulus, $S_{10} - S_5/5$ value and electric resistance of the filaments were measured, and the results are shown in Table 2.

The resulting composite filaments were mixed with a nylon-6 yarn (200 de/34 fil) by means of a turbulent-flow type air nozzle, and a knitted fabric was produced from the mixed yarn. The noticeability of the electrically conductive composite filaments in the knitted fabric was evaluated on the scale of good, fair and poor as follows:

Good: not noticeable
Fair: slightly noticeable
Poor: noticeable

The results are shown in Table 2.

Table 2

| Run No. | Core:sheath ratio (by weight) | Tenacity (g/de) | Elongation (%) | Young's Modulus (Kg/mm²) | $\frac{S_{10} - S_5}{5}$ | Electric resistance (ohms/cm) | Noticeability |
|---|---|---|---|---|---|---|---|
| 6 | 1.5:98.5 | 3.31 | 69.5 | 140 | 0.13 | $1.0 \times 10^{11}$ | Good |
| 7 | 3:97 | 3.16 | 67.8 | 141 | 0.13 | $9.8 \times 10^9$ | Good |
| 8 | 10:90 | 3.02 | 66.0 | 145 | 0.12 | $7.2 \times 10^9$ | Good |
| 9 | 25:75 | 2.95 | 65.1 | 148 | 0.14 | $4.3 \times 10^9$ | Fair |
| 10 | 35:65 | 2.79 | 64.4 | 150 | 0.14 | $2.1 \times 10^9$ | Poor |

EXAMPLE 3

The same core and sheath polymers, spinning apparatus, spinning pack and spinning temperature as in Example 2 were used, but the spinning was carried out at varying take-up speeds. The number of filaments was 3, and the amount of the polymers to be melt-extruded was adjusted so that the denier size of the filaments after take-up became 30 denier/3 filaments. The core-to-sheath ratio was fixed at 10:90.

The tenacity, elongation, Young's modulus, and electric resistance of the resulting composite filaments were measured, and the results are shown in Table 3.

The resulting composite filaments were mixed with a nylon-6 yarn (200 denier/39 fil) by means of a turbulent-flow type air nozzle. A knitted fabric was produced from the mixed yarn, and its initial frictional voltage and frictional voltage after pulling and rubbing were measured. The results are also shown in Table 3.

Table 3

| Run No. | Take-up speed (m/min.) | Tenacity (g/de) | Elongation (%) | Young's modulus (Kg/mm²) | $\frac{S_{10} - S_5}{5}$ | Electric resistance (ohms/cm) | Initial frictional voltage (V) | Frictional voltage after pulling and rubbing (V) | difference of dyeability* |
|---|---|---|---|---|---|---|---|---|---|
| 11 (comparison) | 1000 | 1.43 | 290.3 | 65 | 0.01 | $6.2 \times 10^9$ | 123 | 2900 | — |
| 12 (comparison) | 2000 | 1.96 | 135.1 | 87 | 0.02 | $7.3 \times 10^9$ | 128 | 1290 | — |
| 13 (invention) | 3000 | 2.89 | 77.8 | 130 | 0.08 | $7.8 \times 10^9$ | 130 | 215 | +7.5 NBS |
| 14 (invention) | 3500 | 3.02 | 66.0 | 145 | 0.12 | $7.2 \times 10^9$ | 132 | 189 | +6.75 NBS |
| 15 (invention) | 4000 | 3.32 | 60.0 | 197 | 0.20 | $9.3 \times 10^9$ | 130 | 185 | +6.75 NBS |

*MEASUREMENT OF THE DIFFERENCE OF DYEABILITY

(1) Preparation of Samples

A circular-knitted fabric was prepared from the filaments of Table 3 Runs Nos. 13 - 15, and Table 4 Run No. 18 respectively and dyed under the following dyeing conditions. The difference of dyeability was then measured.

(2) Dyeing conditions

Dye and its concentration: SUPRANOL CYANINE G (a product of Bayer AG; C.I. Acid Blue 90), 0.50 o.w.f.

Dyeing assistant and its concentration:

MIKUREGAL 2M (a product of Nippon Senka Kogyo Kabushiki Kaisha; an anionic level dyeing assistant agent of higher fatty acid ester salt), 0.20 o.w.f.

Goods-to-liquor ratio: 1:50 pH: 5 (adjusted with acetic acid)

Dyeing temperature and other conditions:

The sample was placed in a bath at 30° C., and heated to 85° C. over the course of 30 minutes. Then, it was maintained at 85° C. for 30 minutes. Then, it was gradually cooled. When the temperature of the bath reached 50° C., the sample was withdrawn from the bath, washed with water, and dried in air.

(3) Measurement of the difference of dyeability

Evaluated by an NBS indicating method based on a gray scale set forth in Japanese Industrial Standards JIS L-0804. The dyeability of the product in Run No. 18 (comparison) was made a standard, and the difference of the dyeability from the standard was determined.

It can be seen from Table 3 that the products obtained in Runs Nos. 11 and 12 had very poor frictional voltages after pulling and rubbing. A microscopic examination of the surface of the knitted fabric showed that most of the composite filaments were broken, and partly dropped off from the fabric.

COMPARATIVE EXAMPLE 2

In the preparation of electrically conductive composite filaments, the as-extruded filaments were taken up at a take-up speed of 1000 m/min., and then drawn at varying draw ratios. The core and sheath polymers, spinning apparatus, spinning pack and spinning temperature used were the same as those in Example 1. The core-to-sheath ratio was 10:90, and the number of filaments was 3. The amount of the polymers extruded was adjusted so that after drawing, the filaments had a denier size of 30 denier/3 filaments. The drawing speed was 800 m/min. The tenacity, elongation, Young's modulus, and electrical resistance of the drawn filaments were measured, and the results are shown in Table 4.

Table 4

| Run No. | Draw ratio | Tenacity (g/de) | Elongation (%) | Young's modulus (Kg/mm²) | $\frac{S_{10} - S_5}{5}$ | Electrical resistance (ohms/cm) |
|---|---|---|---|---|---|---|
| 16 | 1.1 | 1.59 | 254.5 | 70 | 0.01 | $9.8 \times 10^9$ |
| 17 | 1.5 | 1.89 | 163.2 | 86 | 0.05 | $1.4 \times 1^{10}$ |
| 18 | 2.5 | 2.71 | 60.4 | 205 | 0.32 | more than $1.0 \times 10^{12}$ |
| 19 | 3.3 | 3.32 | 20.2 | 280 | 0.41 | more than $1.0 \times 10^{12}$ |

It can be seen from the results shown in Table 4 that when the draw ratio is low, the drawing merely results in the plastic deformation of the filaments, and although their electric conductivity is not reduced, the orientation of the filaments is not promoted and the dynamic properties of the filaments are not improved. On the other hand, when the draw ratio becomes higher, the orientation of the filaments is promoted, and the dynamic properties of the filaments are improved, but their electric conductivity is reduced. Thus, the results of Table 4 demonstrate that electrically conductive composite filaments of good quality cannot be obtained by a process consisting of a spinning step and a drawing step.

What we claim is:

1. A process for producing sheath-core type electrically conductive synthetic composite filaments, which comprises simultaneously melt-extruding from a spinneret, in a sheath-core filament configuration, an electrically conductive core composition of polycapramide containing an electrically conductive carbon black dispersed therein, and a non-conductive sheath composition of polycapramide and taking up the extruded sheath-core type synthetic filaments at a take-up speed of at least 2,500 meters per minute, with the proviso that said process is carried out without a separate drawing step.

2. The process of claim 1 wherein the take-up speed is 3,000 to 4,000 meters per minute.

3. The process of claim 1 wherein the extruded sheath-core type synthetic filaments are taken up at a draft ratio of 80 to 600.

4. The process of claim 1 wherein the electrically conductive core composition contains the electrically conductive carbon black dispersed therein in an amount of 15 to 50% by weight based on the weight of the core composition.

5. The process of claim 1 wherein the composite filaments have a core-to-sheath ratio of 2:98 to 30:70.

6. The process of claim 1 wherein a melt of the core composition is fed into the core side of the spinneret without filtering the composition.

7. The process of claim 1 wherein a melt of the core composition is fed into the core side of the spinneret after filtering said composition by means of a wire gauze of not more than 200 mesh.

8. The process of claim 1 wherein a melt of the core composition is fed into the core side of the spinneret after filtering said composition by means of a wire gauze of not more than 200 mesh and a granular filtering material having an average particle diameter of at least 150 microns.

* * * * *